US010236645B1

(12) United States Patent
Yang

(10) Patent No.: US 10,236,645 B1
(45) Date of Patent: Mar. 19, 2019

(54) ELECTRICAL CONNECTOR

(71) Applicant: ALL BEST PRECISION TECHNOLOGY CO., LTD., Taoyuan (TW)

(72) Inventor: Haven Yang, New Taipei (TW)

(73) Assignee: ALL BEST PRECISION TECHNOLOGY CO., LTD. (TW)

( * ) Notice: Subject to any disclaimer, the term of this patent is extended or adjusted under 35 U.S.C. 154(b) by 11 days.

(21) Appl. No.: 15/794,514

(22) Filed: Oct. 26, 2017

(51) Int. Cl.

| | |
|---|---|
| ***H01R 13/648*** | (2006.01) |
| ***H01R 24/30*** | (2011.01) |
| ***H01R 13/516*** | (2006.01) |
| ***H01R 13/40*** | (2006.01) |

(52) U.S. Cl.
CPC ..... *H01R 24/30* (2013.01); *H01R 13/40* (2013.01); *H01R 13/516* (2013.01)

(58) Field of Classification Search
CPC ..... H01R 13/40; H01R 13/516; H01R 24/58
See application file for complete search history.

(56) References Cited

U.S. PATENT DOCUMENTS

| | | | | |
|---|---|---|---|---|
| 6,210,218 | B1 * | 4/2001 | Chang | H01R 12/7029 439/567 |
| 7,175,447 | B2 * | 2/2007 | Pan | H01R 12/727 439/79 |
| 9,093,800 | B2 * | 7/2015 | Laub | H01R 12/727 |
| 2015/0280375 | A1 * | 10/2015 | Xu | H01R 13/6594 439/607.01 |

* cited by examiner

*Primary Examiner* — Xuong M Chung Trans
(74) *Attorney, Agent, or Firm* — Schmeiser, Olsen & Watts, LLP

(57) ABSTRACT

An electrical connector includes a terminal module and a housing receiving the terminal module therein. The terminal module includes a first, a second, a third and a fourth terminal module, which include a first, a second, a third and a fourth terminal unit, respectively. The second and the third terminal unit are located at a distance behind the first and the fourth terminal unit. At least one of the first, the second, the third and the fourth terminal unit includes one ground terminal and two signal terminals arranged on at least one lateral side thereof from an outmost position to two inner positions. The housing includes an upper cover and a lower cover that are connected and closed to each other; the lower cover includes a hollow-out area, in which a connection end of each of the first, the second, the third and the fourth terminal unit is received.

16 Claims, 5 Drawing Sheets

ELECTRICAL CONNECTOR

FIELD OF THE INVENTION

The present invention relates to an electrical connector, and more particularly, to an electrical connector to be used with an electronic plug member.

BACKGROUND OF THE INVENTION

Generally, an electrical connector for an electronic plug member to insert thereinto includes a housing, four terminal units and at least four supports. The terminal units are separately arranged on each of the supports in two rows, namely, an upper and a lower row, and the supports with the terminal units arranged thereon are sequentially disposed in the housing to complete the electrical connector.

To match the electronic products to be used with, the above-described electrical connector usually has a small and compact volume and light weight, and the terminals in the terminal units are also very thin. After the terminals in the terminal units have been mounted on the supports, the supports with the terminal units mounted thereon must be sequentially disposed in the housing. During the assembling, the terminal units tend to interfere with one another to result in bent or even damaged terminals, which would inevitably affect the yield and the subsequent use of the electrical connector.

It is therefore tried by the inventor to develop an electrical connector that can be quickly assembled and easily manufactured at upgraded yield to effectively improve the prior art electrical connector.

SUMMARY OF THE INVENTION

A primary object of the present invention is to provide an electrical connector that can be quickly assembled and easily manufactured at upgraded yield to thereby overcome the disadvantages of the prior art electrical connector.

To achieve the above and other objects, the electrical connector according to the present invention includes a terminal module and a housing. The terminal module includes a first terminal module, a second terminal module, a third terminal module and a fourth terminal module, which are sequentially arranged from bottom to top. The first terminal module includes a first terminal unit, the second terminal module includes a second terminal unit, the third terminal module includes a third terminal unit, and the fourth terminal module includes a fourth terminal unit. The first and the fourth terminal unit are arranged corresponding to each other, the second and the third terminal unit are arranged corresponding to each other, and the second terminal unit and the third terminal unit are located at a distance behind the first terminal unit and the fourth terminal unit. At least one of the first, the second, the third and the fourth terminal unit includes one ground terminal and two signal terminals arranged on at least one lateral side thereof from an outmost position to two inner positions. The housing receives the terminal module therein and includes an upper cover and a lower cover that are connected and closed to each other. The lower cover includes a hollow-out area. The first terminal unit, the second terminal unit, the third terminal unit and the fourth terminal unit respectively have a connection end, which are received in the hollow-out area of the housing.

In the electrical connector of the present invention, the first terminal module further includes a first seat, which is associated with the first terminal unit, and the first terminal unit includes a plurality of first terminals. Each of the first terminals includes a main body, a contact end located at one of two opposite ends of the main body and a connection end located at the other end of the main body. The connection ends of the first terminals together define the connection end of the first terminal unit. The main bodies of the first terminals are embedded in the first seat.

In the electrical connector of the present invention, the second terminal module further includes a second seat, which is associated with the second terminal unit, and the second terminal unit includes a plurality of second terminals. Each of the second terminals includes a main body, a contact end located at one of two opposite ends of the main body and a connection end located at the other end of the main body. The connection ends of the second terminals together define the connection end of the second terminal unit. The main bodies of the second terminals are embedded in the second seat.

In the electrical connector of the present invention, the third terminal module further includes a third seat, which is associated with the third terminal unit, and the third terminal unit includes a plurality of third terminals. Each of the third terminals includes a main body, a contact end located at one of two opposite ends of the main body and a connection end located at the other end of the main body. The connection ends of the third terminals together define the connection end of the third terminal unit. The main bodies of the third terminals are embedded in the third seat.

In the electrical connector of the present invention, the fourth terminal module further includes a fourth seat, which is associated with the fourth terminal unit, and the fourth terminal unit includes a plurality of fourth terminals. Each of the fourth terminals includes a main body, a contact end located at one of two opposite ends of the main body and a connection end located at the other end of the main body. The connection ends of the fourth terminals together define the connection end of the fourth terminal unit. The main bodies of the fourth terminals are embedded in the fourth seat.

In the electrical connector of the present invention, the hollow-out area consists of a first hollow-out section, a second hollow-out section, a third hollow-out section and a fourth hollow-out section. The connection end of the first, the second, the third and the fourth terminal unit are received in the first, the second, the third and the fourth hollow-out section of the hollow-out area, respectively.

In the electrical connector of the present invention, the first hollow-out section includes a first transverse receiving hole and a plurality of first longitudinal receiving holes communicable with the first transverse receiving hole; and the connection end of the first terminal unit is received in the first transverse receiving hole and the first longitudinal receiving holes of the first hollow-out section.

In the electrical connector of the present invention, the second hollow-out section includes a second transverse receiving hole and a plurality of second longitudinal receiving holes communicable with the second transverse receiving hole; and the connection end of the second terminal unit is received in the second transverse receiving hole and the second longitudinal receiving holes of the second hollow-out section.

In the electrical connector of the present invention, the third hollow-out section includes a third transverse receiving hole and a plurality of third longitudinal receiving holes communicable with the third transverse receiving hole; and the connection end of the third terminal unit is received in the third transverse receiving hole and the third longitudinal receiving holes of the third hollow-out section.

In the electrical connector of the present invention, the fourth hollow-out section includes a fourth transverse receiving hole and a plurality of fourth longitudinal receiving holes communicable with the fourth transverse receiving hole; and the connection end of the fourth terminal unit is received in the fourth transverse receiving hole and the fourth longitudinal receiving holes of the fourth hollow-out section.

In the electrical connector of the present invention, the lower cover includes a first rib, which is located between the first and the second hollow-out section and includes a first grounding member; a second rib, which is located between the second and the third hollow-out section and includes a second grounding member; and a third rib, which is located between the third and the fourth hollow-out section and includes a third grounding member.

In the electrical connector of the present invention, the first, the second and the third grounding member respectively have a plurality of pins; and the pins of the first, the second and the third grounding member are in contact with the ground terminals in the first, the second, the third and the fourth terminal unit, respectively.

In the electrical connector of the present invention, the first terminal module further includes a first seat associated with the first terminal unit, the second terminal module further includes a second seat associated with the second terminal unit, the third terminal module further includes a third seat associated with the third terminal unit, and the fourth terminal module further includes a fourth seat associated with the fourth terminal unit; and the housing has a snug-fit space adjacent to each of two lateral inner sides thereof The first, the second, the third and the fourth seat are sequentially disposed in the housing from bottom to top, such that two lateral sides of the first, the second, the third and the fourth seat are snuggly fitted in the snug-fit spaces.

In the electrical connector of the present invention, the housing defines an insertion slot at an end thereof; and the upper cover and the lower cover are respectively formed at an inner side of an end corresponding to the insertion slot with a plurality of grooves communicable with the insertion slot. The contact end of the fourth terminal unit and the contact end of the first terminal unit are received in the grooves formed on the upper cover and the lower cover, respectively.

In the electrical connector of the present invention, the upper cover is provided with a plurality of coupling sections, and the lower cover is correspondingly provided with a plurality of mating coupling sections adapted to couple with the coupling sections.

In the electrical connector of the present invention, the coupling sections can be recesses or protrusions while the mating coupling sections can be protrusions or recesses for correspondingly engaging with the recesses or protrusions of the coupling sections.

With the above arrangements, the first, the second, the third and the fourth terminal module can be quickly assembled to one another to complete the terminal module, and the completed terminal module can be easily disposed in the housing to complete the electrical connector. Therefore, the electrical connector of the present invention can be quickly assembled and easily manufactured at upgraded yield.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof and by referring to the accompanying drawings.

Please refer to FIGS. 1 to 5. As shown, the present invention provides an electrical connector including a terminal module 1 and a housing 2.

Figure 1:
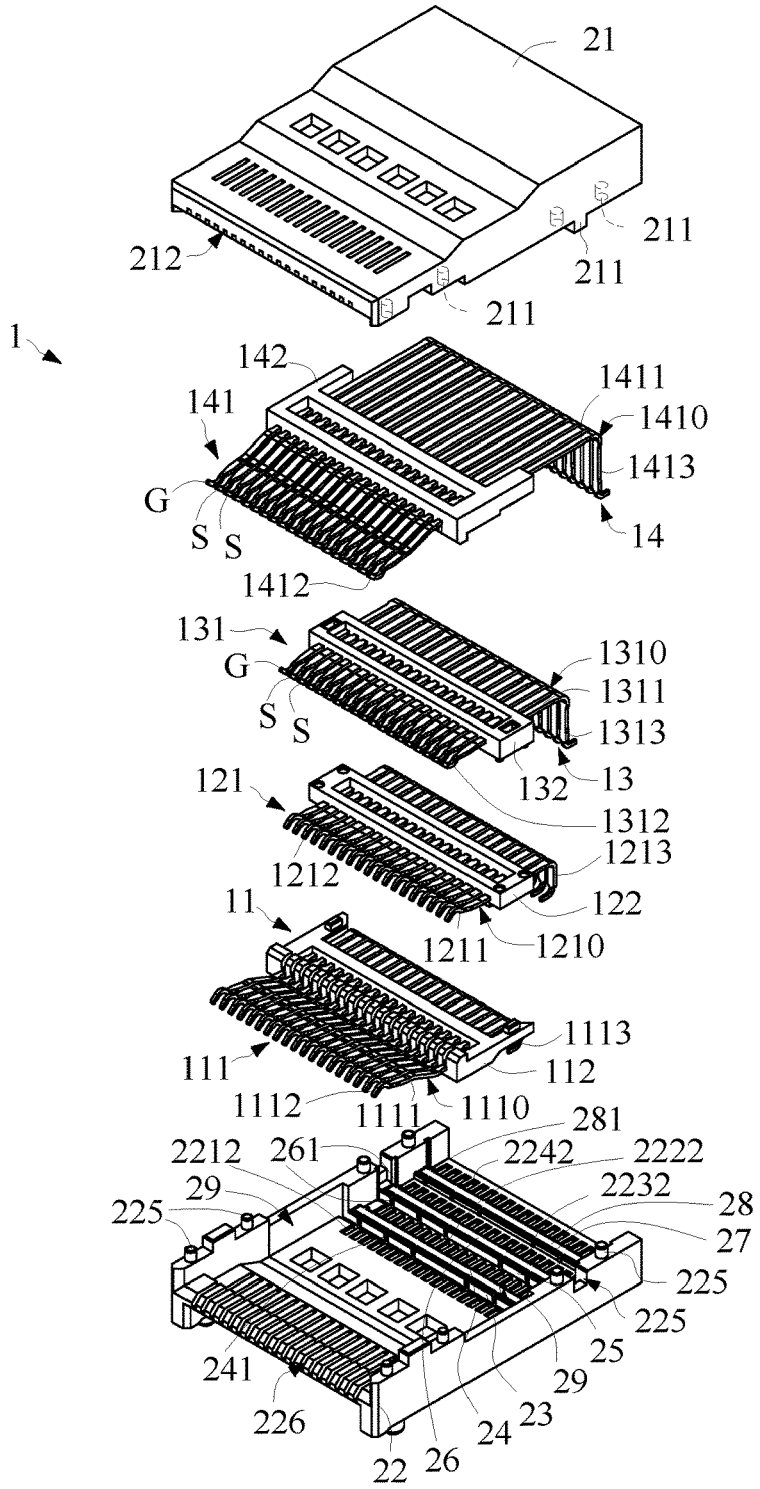
FIG. 1 is a fully exploded perspective view of an electrical connector according to a preferred embodiment of the present invention.

The terminal module 1 includes a first terminal module 11, a second terminal module 12, a third terminal module 13 and a fourth terminal module 14, which are sequentially arranged from bottom to top. The first terminal module 11 includes a first terminal unit 111, the second terminal module 12 includes a second terminal unit 121, the third terminal module 13 includes a third terminal unit 131, and the fourth terminal module 14 includes a fourth terminal unit 141. The second and the third terminal unit 121, 131 are located between the first and the fourth terminal unit 111, 141. The first and the fourth terminal unit 111, 141 are arranged corresponding to each other for electrically contacting with an electronic plug member (not shown); and the second and the third terminal unit 121, 131 are arranged corresponding to each other for electrically contacting with the electronic plug member (not shown). A contact end 1212 of the second terminal unit 121 and a contact end 1312 of the third terminal unit 131 are located at a distance behind a contact end 1112 of the first terminal unit 111 and a contact end 1412 of the fourth terminal unit 141. At least one of the first, the second, the third and the fourth terminal unit 111, 121, 131, 141 includes one ground terminal G and two signal terminals S arranged on a left side or a right side or on both left and right sides thereof from an outmost position to two inner positions. In FIG. 1, it is shown the ground terminal G and two signal terminals S are arranged on the third terminal unit 131. However, it is understood the ground terminal G and the two signal terminals S can also be arranged on other terminal units. With the above arrangements, the terminal module 1 according to the present invention can be applied to a QSFP-DD electrical connector or an SFP-DD electrical connector.

The housing 2 receives the terminal module 1 therein, and includes an upper cover 21 and a lower cover 22 that are connected and closed to each other. The lower cover 22 includes a hollow-out area 220 consisting of a first hollow-out section 221, a second hollow-out section 222, a third hollow-out section 223 and a fourth hollow-out section 224. The first, the second, the third and the fourth terminal unit 111, 121, 131, 141 respectively have a connection end 1113, 1213, 1313, 1413, which are respectively received in the first, the second, the third and the fourth hollow-out section 221, 222, 223, 224 of the hollow-out area 220. The upper cover 21 is provided with a plurality of coupling sections 211, and the lower cover 22 is correspondingly provided with a plurality of mating coupling sections 225 adapted to couple with the coupling sections 211.

In the preferred embodiment of the present invention, the first terminal module 11 further includes a first seat 112, which is associated with the first terminal unit 111. And, the first terminal unit 111 includes a plurality of first terminals 1110, each of which includes a main body 1111, a contact end 1112 located at one of two opposite ends of the main body 1111, and a connection end 1113 located at the other end of the main body 1111. The connection ends 1113 of the first terminals 1110 together define the connection end 1113 of the first terminal unit 111. The main bodies 1111 of the first terminals 1110 are embedded in the first seat 112.

In the preferred embodiment of the present invention, the second terminal module 12 further includes a second seat 122, which is associated with the second terminal unit 121. And, the second terminal unit 121 includes a plurality of second terminals 1210, each of which includes a main body 1211, a contact end 1212 located at one of two opposite ends of the main body 1211, and a connection end 1213 located at the other end of the main body 1211. The connection ends 1213 of the second terminals 1210 together define the connection end 1213 of the second terminal unit 121. The main bodies 1211 of the second terminals 1210 are embedded in the second seat 122.

In the preferred embodiment of the present invention, the third terminal module 13 further includes a third seat 132, which is associated with the third terminal unit 131. And, the third terminal unit 131 includes a plurality of third terminals 1310, each of which includes a main body 1311, a contact end 1312 located at one of two opposite ends of the main body 1311, and a connection end 1313 located at the other end of the main body 1311. The connection ends 1313 of the third terminals 1310 together define the connection end 1313 of the third terminal unit 131. The main bodies 1311 of the third terminals 1310 are embedded in the third seat 132.

In the preferred embodiment of the present invention, the fourth terminal module 14 further includes a fourth seat 142, which is associated with the fourth terminal unit 141. And, the fourth terminal unit 141 includes a plurality of fourth terminals 1410, each of which includes a main body 1411, a contact end 1412 located at one of two opposite ends of the main body 1411, and a connection end 1413 located at the other end of the main body 1411. The connection ends 1413 of the fourth terminals 1410 together define the connection end 1413 of the fourth terminal unit 141. The main bodies 1411 of the fourth terminals 1410 are embedded in the fourth seat 142.

In the preferred embodiment of the present invention, the first hollow-out section 221 includes a first transverse receiving hole 2211 and a plurality of first longitudinal receiving holes 2212 communicable with the first transverse receiving hole 2211; the second hollow-out section 222 includes a second transverse receiving hole 2221 and a plurality of second longitudinal receiving holes 2222 communicable with the second transverse receiving hole 2221; the third hollow-out section 223 includes a third transverse receiving hole 2231 and a plurality of third longitudinal receiving holes 2232 communicable with the third transverse receiving hole 2231; and the fourth hollow-out section 224 includes a fourth transverse receiving hole 2241 and a plurality of fourth longitudinal receiving holes 2242 communicable with the fourth transverse receiving hole 2241.

Figure 2:
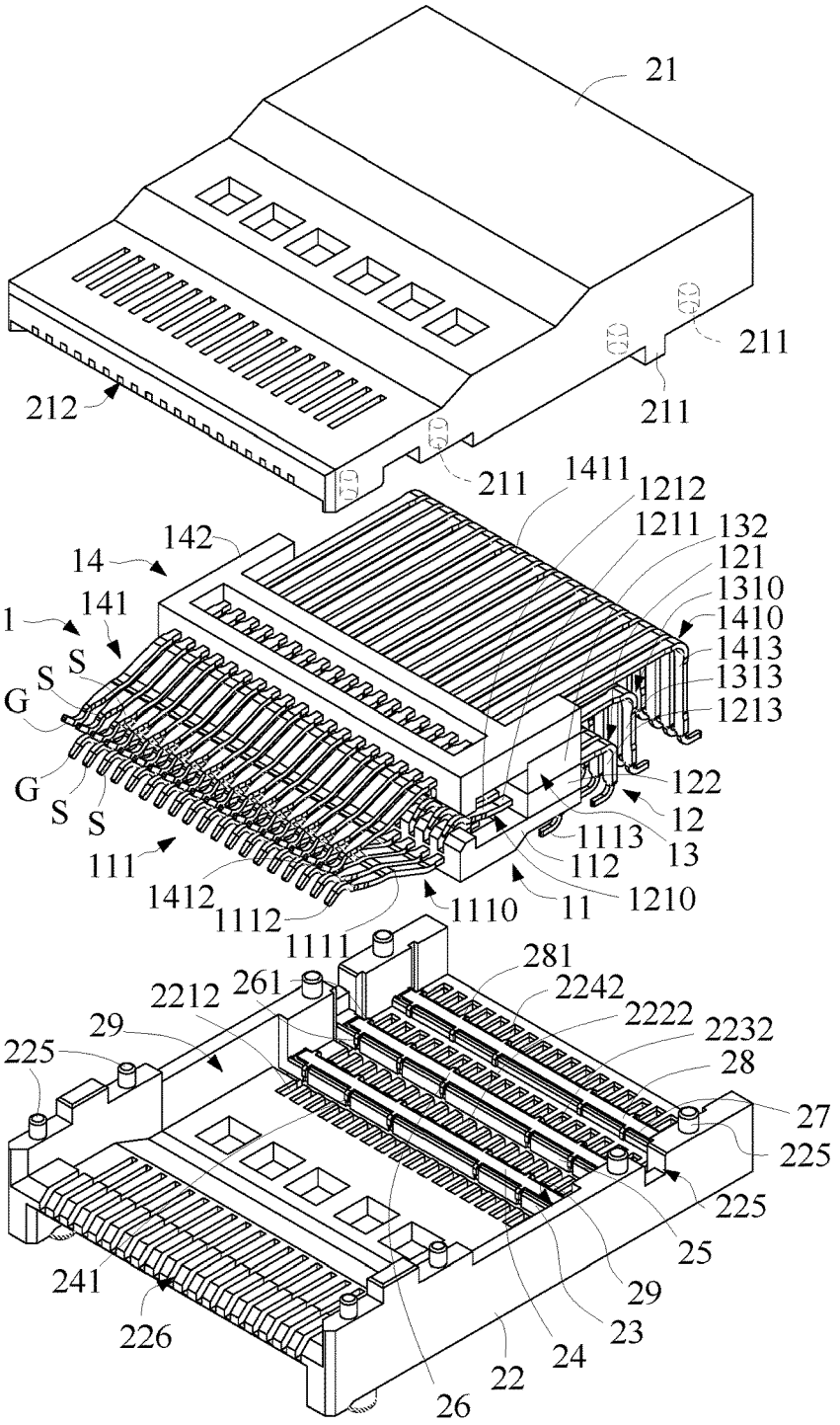
FIG. 2 is a partially assembled view of FIG. 1.
Figure 3:
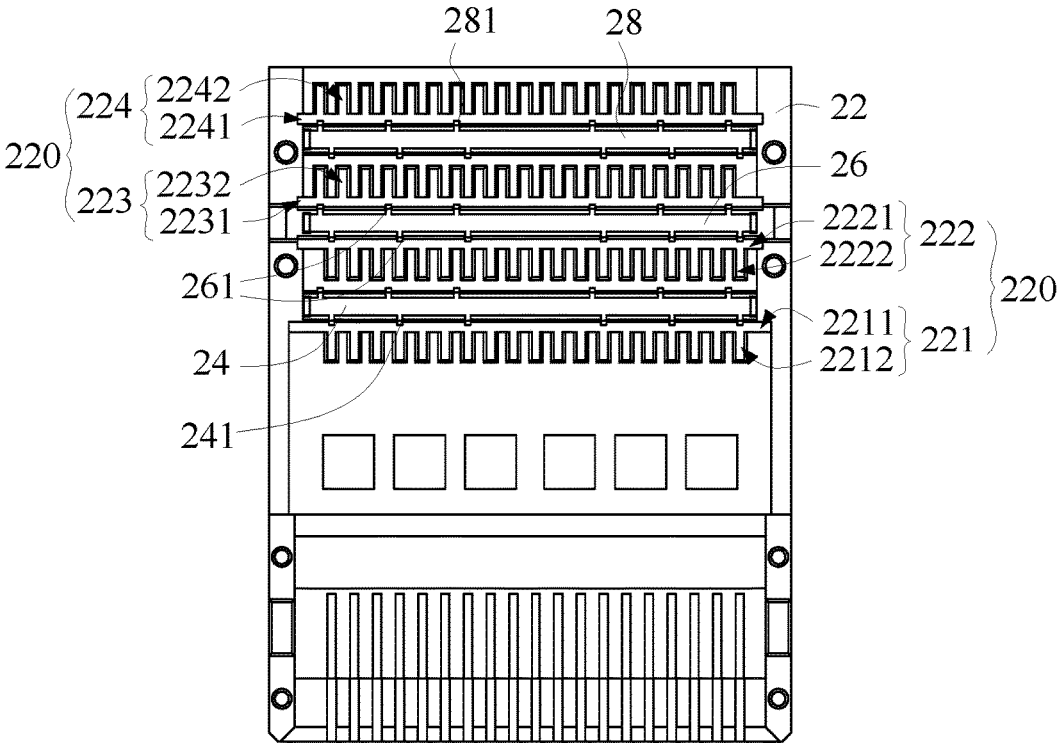
FIG. 3 is a top view of a lower cover of the electrical connector according to the preferred embodiment of the present invention.
Figure 4:
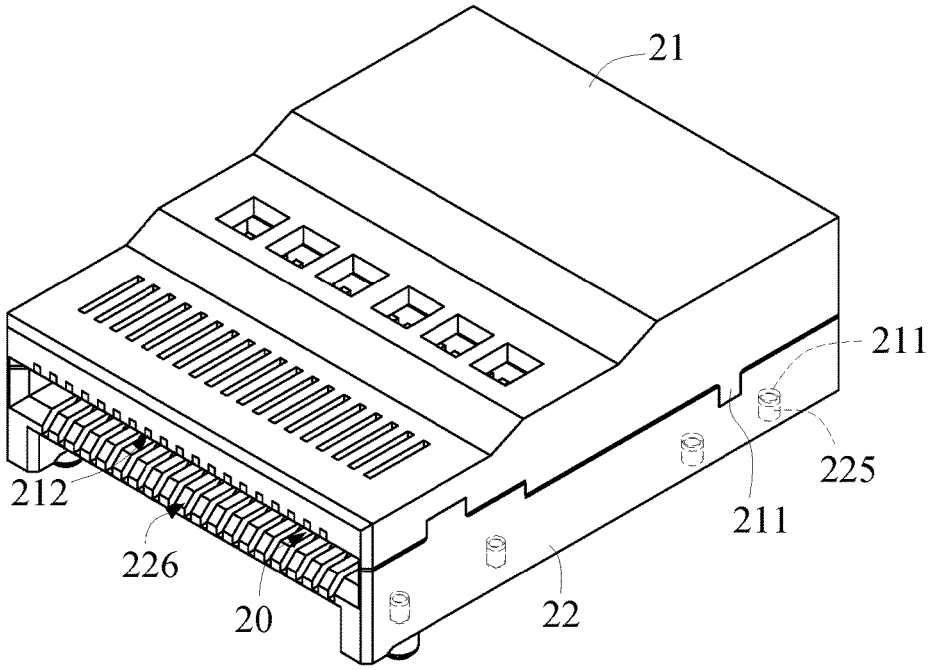
FIG. 4 is a fully assembled perspective view of the electrical connector according to the preferred embodiment of the present invention.
Figure 5:
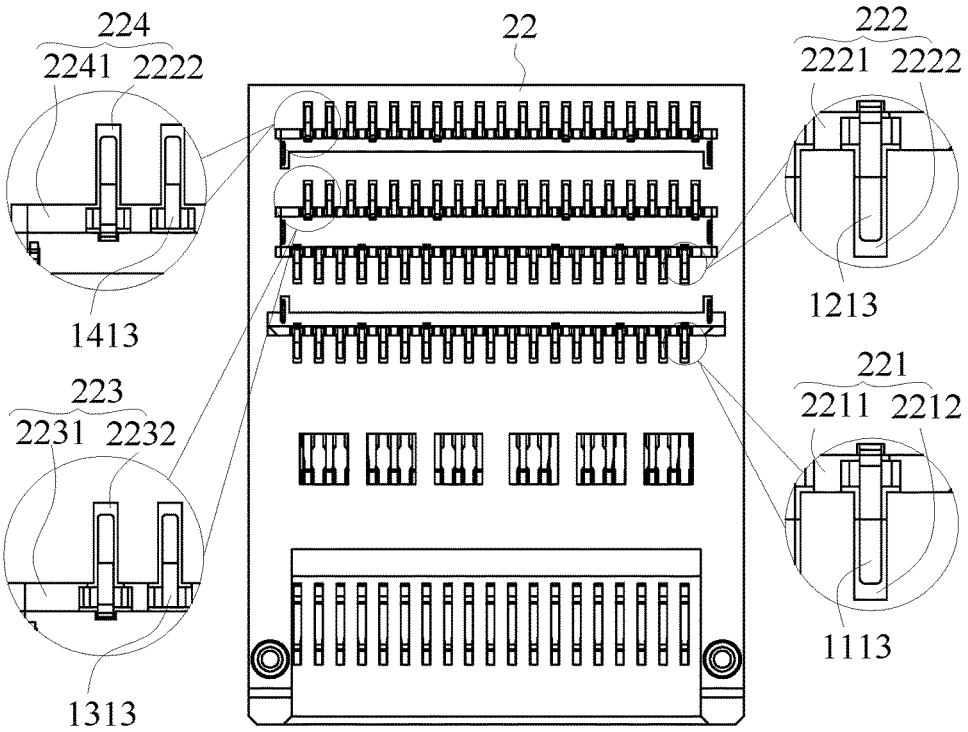
FIG. 5 is a bottom view of the lower cover of the electrical connector according to the preferred embodiment of the present invention.

In the preferred embodiment of the present invention, as can be seen in FIG. 4, the housing 2 defines an insertion slot 20 at a front end thereof, and the upper cover 21 and the lower cover 22 are formed at their inner front ends with a plurality of grooves 212, 226, respectively, communicable with the insertion slot 20. Further, as can be most clearly seen in FIG. 2, the lower cover 22 includes a first rib 23, which is located between the first and the second hollow-out section 221, 222 and includes a first grounding member 24; a second rib 25, which is located between the second and the third hollow-out section 222, 223 and includes a second grounding member 26; and a third rib 27, which is located between the third and the fourth hollow-out section 223, 224 and includes a third grounding member 28. The first, the second and the third grounding member 24, 26, 28 respectively have a plurality of pins 241, 261, 281. As can be seen in FIG. 2, there is a snug-fit space 29 provided in the housing 2 adjacent to each of two lateral inner sides of the housing 2.

To assemble the electrical connector of the present invention, first sequentially dispose the first seat 112 of the first terminal module 11, the second seat 122 of the second terminal module 12, the third seat 132 of the third terminal module 13 and the fourth seat 142 of the fourth terminal module 14 from bottom to top to form the terminal module 1. Then, place the terminal module 1 in the lower cover 20 with two lateral sides of the first, the second, the third and the fourth seat 112, 122, 132, 142 being snuggly fitted in the snug-fit spaces 29 in the housing 2, such that the contact ends 1112 of the first terminals 1110 are received in the grooves 226, the connection ends 1113 of the first terminals 1110 are received in the first transverse receiving hole 2211 and the first longitudinal receiving holes 2212 of the first hollow-out section 221, the connection ends 1213 of the second terminals 1210 are received in the second transverse receiving hole 2221 and the second longitudinal receiving holes 2222 of the second hollow-out section 222, the connection ends 1313 of the third terminals 1310 are received in the third transverse receiving hole 2231 and the third longitudinal receiving holes 2232 of the third hollow-out section 223, and the connection ends 1413 of the fourth terminals 1410 are received in the fourth transverse receiving hole 2241 and the fourth longitudinal receiving holes 2242 of the fourth hollow-out section 224. Meanwhile, the ground terminals G in the first, the second, the third and the fourth terminal unit 111, 121, 131, 141 are caused to contact with the pins 241, 261, 281 of the first, the second and the third grounding member 24, 26, 28 via the connection ends 1113, 1213, 1313, 1413 of the first, the second, the third and the fourth terminal unit 111, 121, 131, 141. Thereafter, close and connect the upper cover 21 to the lower cover 22 by engaging the coupling sections 211 of the upper cover 21 with the mating coupling sections 225 of the lower cover 22, so that the contact ends 1412 of the fourth terminals 1410 are received in the grooves 212 on the upper cover 21 to complete the assembling of the electrical connector. With the electrical connector of the present invention, the connection end 1113 of the first terminal module 11, the connection end 1213 of the second terminal module 12, the connection end 1313 of the third terminal module 13 and the connection end 1413 of the fourth terminal module 14 are received in the first hollow-out section 221, the second hollow-out section 222, the third hollow-out section 223 and the fourth hollow-out section 224 of the lower cover 22, respectively; or the first seat 112 of the first terminal unit 11, the second 122 of the second terminal unit 12, the third seat 132 of the third terminal unit 13 and the fourth seat 142 of the fourth terminal unit 14 can be further snugly fitted and stably located in the snug-fit spaces 29 at two lateral inner sides of the housing 2. In this manner, the electrical connector of the present invention can be quickly assembled and easily manufactured at upgraded yield.

Moreover, in the electrical connector of the present invention, the coupling sections 211 can be recesses or protrusions while the mating coupling sections 225 can be protrusions or recesses for correspondingly engaging with the recesses or protrusions of the coupling sections 211. Alternatively, the coupling sections 211 and the mating coupling sections 225 can be respectively a combination of sunken holes, through holes and bosses to enable corresponding engagement of the upper and the lower cover 21, 22.

The present invention has been described with a preferred embodiment thereof and it is understood that the preferred embodiment is only illustrative and not intended to limit the present invention in any way and many changes and modifications in the described embodiment can be carried out without departing from the scope and the spirit of the invention that is intended to be limited only by the appended claims.

What is claimed is:

1. An electrical connector, comprising:

a terminal module including a first terminal module, a second terminal module, a third terminal module and a fourth terminal module, which are sequentially arranged from bottom to top; the first terminal module including a first terminal unit, the second terminal module including a second terminal unit, the third terminal module including a third terminal unit, and the fourth terminal module including a fourth terminal unit; the first and the fourth terminal unit being arranged corresponding to each other while the second and the third terminal unit being arranged corresponding to each other, and a contact end of the second terminal unit and a contact end of the third terminal unit being located at a distance behind a contact end of the first terminal unit and a contact end of the fourth terminal unit; at least one of the first, the second, the third and the fourth terminal unit including one ground terminal and two signal terminals arranged on at least one lateral side thereof from an outmost position to two inner positions; and a housing receiving the terminal module therein and including an upper cover and a lower cover that are connected and closed to each other; and the lower cover including a hollow-out area; and the first terminal unit, the second terminal unit, the third terminal unit and the fourth terminal unit respectively having a connection end, which are received in the hollow-out area of the housing.

2. The electrical connector as claimed in claim 1, wherein the first terminal module further includes a first seat, which is associated with the first terminal unit, and the first terminal unit includes a plurality of first terminals; each of the first terminals including a main body, a contact end located at one of two opposite ends of the main body and a connection end located at the other end of the main body; the connection ends of the first terminals together defining the connection end of the first terminal unit; and the main bodies of the first terminals being embedded in the first seat.

3. The electrical connector as claimed in claim 1, wherein the second terminal module further includes a second seat, which is associated with the second terminal unit, and the second terminal unit includes a plurality of second terminals; each of the second terminals including a main body, a contact end located at one of two opposite ends of the main body and a connection end located at the other end of the main body; the connection ends of the second terminals together defining the connection end of the second terminal unit; and the main bodies of the second terminals being embedded in the second seat.

4. The electrical connector as claimed in claim 1, wherein the third terminal module further includes a third seat, which is associated with the third terminal unit, and the third terminal unit includes a plurality of third terminals; each of the third terminals including a main body, a contact end located at one of two opposite ends of the main body and a connection end located at the other end of the main body; the connection ends of the third terminals together defining the connection end of the third terminal unit; and the main bodies of the third terminals being embedded in the third seat.

5. The electrical connector as claimed in claim 1, wherein the fourth terminal module further includes a fourth seat, which is associated with the fourth terminal unit, and the fourth terminal unit includes a plurality of fourth terminals; each of the fourth terminals including a main body, a contact end located at one of two opposite ends of the main body and a connection end located at the other end of the main body; the connection ends of the fourth terminals together defining the connection end of the fourth terminal unit; and the main bodies of the fourth terminals being embedded in the fourth seat.

6. The electrical connector as claimed in claim 1, wherein the hollow-out area consists of a first hollow-out section, a second hollow-out section, a third hollow-out section and a fourth hollow-out section; and the connection end of the first, the second, the third and the fourth terminal unit being received in the first, the second, the third and the fourth hollow-out section of the hollow-out area, respectively.

7. The electrical connector as claimed in claim 6, wherein the first hollow-out section includes a first transverse receiving hole and a plurality of first longitudinal receiving holes communicable with the first transverse receiving hole; and the connection end of the first terminal unit being received in the first transverse receiving hole and the first longitudinal receiving holes of the first hollow-out section.

8. The electrical connector as claimed in claim 6, wherein the second hollow-out section includes a second transverse receiving hole and a plurality of second longitudinal receiving holes communicable with the second transverse receiving hole; and the connection end of the second terminal unit being received in the second transverse receiving hole and the second longitudinal receiving holes of the second hollow-out section.

9. The electrical connector as claimed in claim 6, wherein the third hollow-out section includes a third transverse receiving hole and a plurality of third longitudinal receiving holes communicable with the third transverse receiving hole; and the connection end of the third terminal unit being received in the third transverse receiving hole and the third longitudinal receiving holes of the third hollow-out section.

10. The electrical connector as claimed in claim 6, wherein the fourth hollow-out section includes a fourth transverse receiving hole and a plurality of fourth longitudinal receiving holes communicable with the fourth transverse receiving hole; and the connection end of the fourth terminal unit being received in the fourth transverse receiving hole and the fourth longitudinal receiving holes of the fourth hollow-out section.

11. The electrical connector as claimed in claim 6, wherein the lower cover includes a first rib, which is located between the first and the second hollow-out section and includes a first grounding member; a second rib, which is located between the second and the third hollow-out section and includes a second grounding member; and a third rib, which is located between the third and the fourth hollow-out section and includes a third grounding member.

12. The electrical connector as claimed in claim 11, wherein the first, the second and the third grounding member respectively have a plurality of pins; and the pins of the first, the second and the third grounding member being in contact with the ground terminals in the first, the second, the third and the fourth terminal unit, respectively.

13. The electrical connector as claimed in claim 1, wherein the first terminal module further includes a first seat associated with the first terminal unit, the second terminal module further includes a second seat associated with the second terminal unit, the third terminal module further includes a third seat associated with the third terminal unit, and the fourth terminal module further includes a fourth seat associated with the fourth terminal unit; and wherein the housing has a snug-fit space adjacent to each of two lateral inner sides thereof; and the first, the second, the third and the fourth seat being sequentially disposed in the housing from bottom to top, such that two lateral sides of the first, the second, the third and the fourth seat are snuggly fitted in the snug-fit spaces.

14. The electrical connector as claimed in claim 1, wherein the housing defines an insertion slot at an end thereof; and the upper cover and the lower cover being respectively formed at an inner side of an end corresponding to the insertion slot with a plurality of grooves communicable with the insertion slot; and the contact end of the first terminal unit and the contact end of the fourth terminal unit being received in the grooves formed on the lower cover and the upper cover, respectively.

15. The electrical connector as claimed in claim 1, wherein the upper cover is provided with a plurality of coupling sections, and the lower cover is correspondingly provided with a plurality of mating coupling sections adapted to couple with the coupling sections.

16. The electrical connector as claimed in claim 15, wherein the coupling sections can be recesses or protrusions while the mating coupling sections can be protrusions or recesses for correspondingly engaging with the recesses or protrusions of the coupling sections.

* * * * *